US006808623B2

(12) United States Patent
Harris et al.

(10) Patent No.: US 6,808,623 B2
(45) **Date of Patent: *Oct. 26, 2004**

(54) TOP OF GRATE CATCH BASIN FILTER

(76) Inventors: John F. Harris, 1464 Ridgeview Pl. NW., Albany, OR (US) 97321; Ardle E. Page, 1455 Center St. SE., Albany, OR (US) 97321

( * ) Notice: Subject to any disclaimer, the term of this patent is extended or adjusted under 35 U.S.C. 154(b) by 0 days.

This patent is subject to a terminal disclaimer.

(21) Appl. No.: 09/778,360

(22) Filed: Feb. 7, 2001

(65) Prior Publication Data

US 2002/0104789 A1 Aug. 8, 2002

(51) Int. Cl.[7] ..... E03F 5/06

(52) U.S. Cl. ..... 210/164; 210/170; 210/434; 404/4

(58) Field of Search ..... 210/162, 163, 210/164, 170, 254, 434; 404/4, 5

(56) References Cited

U.S. PATENT DOCUMENTS 2,548,541 A * 4/1951 MacDonald ..... 210/434
5,372,714 A 12/1994 Logue
5,405,539 A * 4/1995 Schneider ..... 210/163
5,575,925 A 11/1996 Logue
5,632,888 A 5/1997 Chinn et al.
5,643,445 A * 7/1997 Billias et al. ..... 210/434
5,849,181 A * 12/1998 Monteith ..... 210/254
5,849,198 A 12/1998 Sharpless
5,954,952 A 9/1999 Strawser, Sr.
6,015,489 A 1/2000 Allen et al.
6,045,691 A 4/2000 McDermott
6,096,200 A 8/2000 Bennett

* cited by examiner

*Primary Examiner*—Christopher Upton
(74) *Attorney, Agent, or Firm*—Robert K. Lau

(57) ABSTRACT

The invention is a removable filter for mounting on the top of a grate for a storm water drain that comprises an overflow bypass that has a water barrier wall that is compressible and thereby safe for traffic. The filter removes pollutants from the storm water prior to the storm water passing through the grate.

5 Claims, 2 Drawing Sheets

TOP OF GRATE CATCH BASIN FILTER

BACKGROUND OF THE INVENTION

1. Field of Invention

This invention relates to a filter for use on a storm sewer catch basin equipped with a top grate. The ground water flows through the filter into the grate and catch basin, and then out the sewer line. Before the ground water flows into the sewer line solid pollutants need to be filtered out of the storm water.

2. Description of the Prior Art

Most catch basin filtration systems are not immediately upstream from drain grates or are not designed for a catch basin with only a grate inlet cover. In the past, filtration has been accomplished using devices which were downstream and below the grate. Most are labor intensive being constructed on site. Caldwell (U.S. Pat. No. 1,310,055) shows a device that strains out only large debris such as sticks and leaves. The modern regulations require that smaller solids such as sand or silt are also removed from storm water.

Chinn, et. al. (U.S. Pat. No. 5,632,888) and McDermott (U.S. Pat. No. 6,045,691) developed a filter upstream from a catch basin chamber but they are designed for curb inlets only and not for a catch basin top with a grate covering. Allen, et al (U.S. Pat. No. 6,015,489), Sharpless (U.S. Pat. No. 5,849,198), Bennett (U.S. Pat. No. 6,096,200), Logue (U.S. Pat. No. 5,575,925) and Logue (U.S. Pat. No. 5,372,714), all develop filtration systems which position the filter apparatus down stream from the inlet opening grate. These are labor intensive to install and maintain.

Strawser Sr. (U.S. Pat. No. 5,954,952) develops a filtration system for catch basins with a curb inlet combined with a gutter inlet. This does not refer to only a grate inlet as in our invention.

Faneli (U.S. Pat. No. 5,733,445) shows an apparatus shows a thin support grate on top of an inlet grate. The support grate is fabricated from metallic material such as steel. This is expensive to manufacture and no overflow by pass is included. Best management practices in OregonDepartment of Transportation BMP Manual, "Hydraulics Manual Volume 2," printed December 1999 pages 3–78 to 3–83 include inlet protection filtration systems which are upstream from a catch basin grate. All such included systems are devices to be constructed on site. A filtration system on top of a grate is shown on page 3–78. This shows a need for such a filter. These on-site fabrications are labor intensive and of inconsistent quality. As described, they are a traffic hazard when placed in a street and have no overflow provision for high flow conditions.

There is a need for a prefabricated filter with a bypass which mounts on the top of a catch Basin. No catch basin filtration systems which essentially rests on top of the grate includes an overflow by pass which is also safe for traffic. For the foregoing reasons there is need for such a storm water catch basin filter.

SUMMARY OF THE INVENTION

Our invention is a removable catch basin filter for a storm sewer catch basin which is equipped with a removable top inlet grate. The filter is essentially located on top of the catch basin grate. The filter is typically composed of a porous geo textile fabric which covers the grate inlet. Pollutant solids are held back by the fabric while the water flows into catch basin through the grate. The filter enwraps the grate thereby preventing storm water from entering the grate without passing through the filter. The filter includes a centrally located by pass opening. A wall water barrier protects the opening and, during low flows, forces the water to enter the grate only through the surrounding filtration fabric. The wall is limited in height. During high water conditions the water flows over this low wall and into the catch basin. This wall is made of a compressible material such as foam rubber and easily flattens with traffic weight. The filter therefore poses little threat to traffic safety. The wall springs the by pass opening top back to its former position when it is no longer weighed down.

DESCRIPTION OF THE PREFERRED EMBODIMENT

Figure 1:
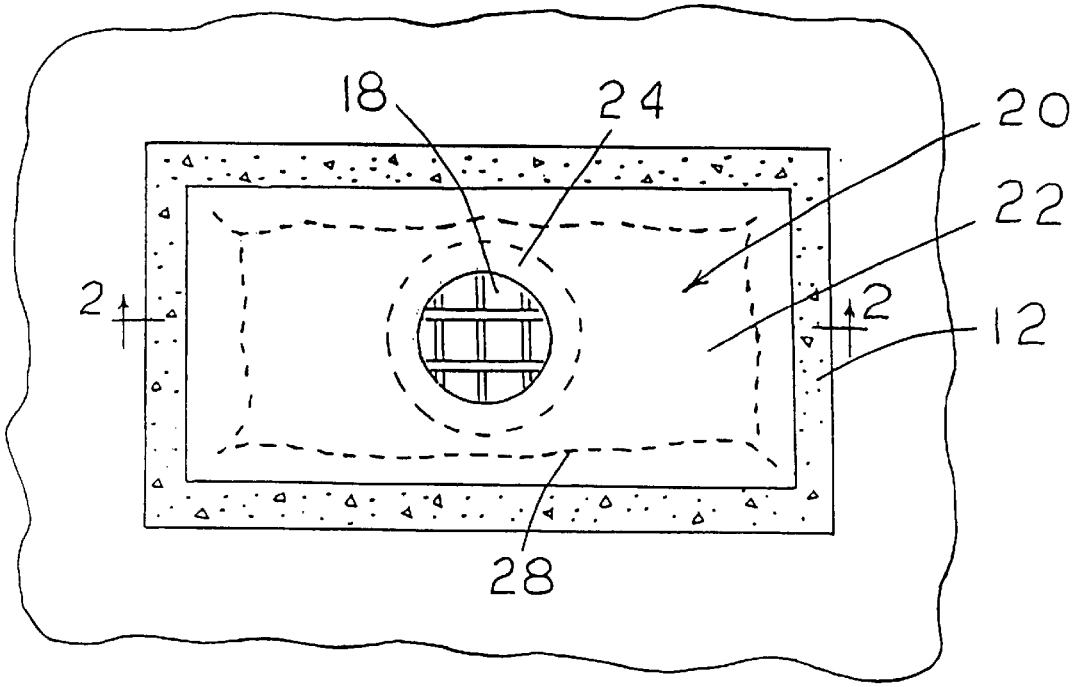
FIG. 1 is a top view of the filter inserted in a catch basin.
Figure 2:
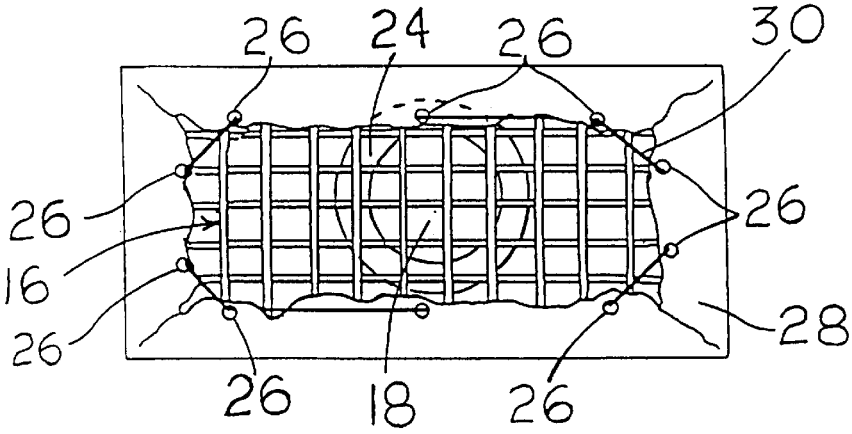
FIG. 2 is a bottom view of the filter attached to the grate with an outer edge of the filter enwrapping the inlet grate.
Figure 3:
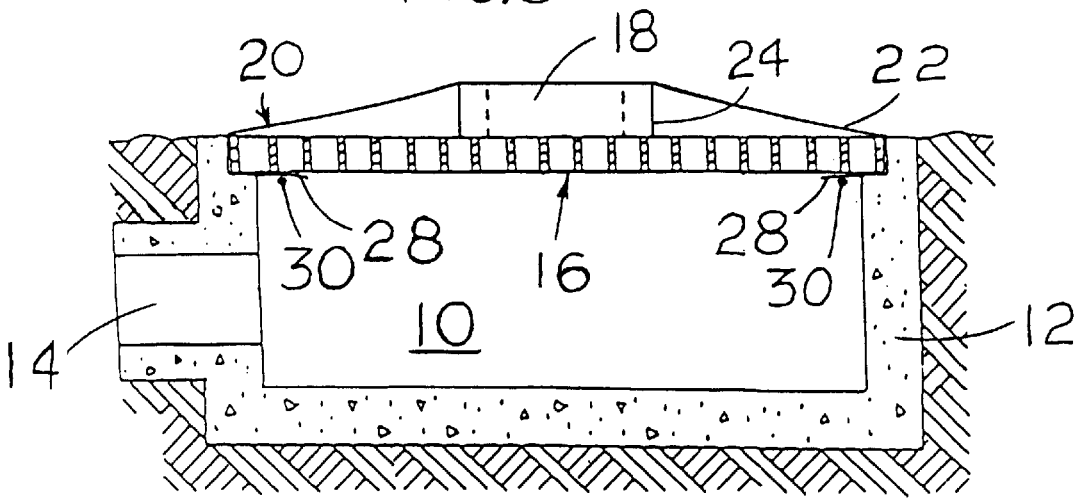
FIG. 3 is a sectional view taken along lines 2-2 of FIG. 1.

Catch basin chamber 10 is defined by a concrete catch basin enclosure 12. Concrete storm sewer pipe outlet 14 extends away from the enclosure. Rectangular inlet grate 16 closes the top of the catch basin. Ground water flows through a filter 20, through the grate, into the catch basin chamber and out the outlet.

Catch basin filter 20 includes a filter fabric 22, and an overflow inlet 18. When the filter is in place, storm water flows through the filter prior to flowing into an inlet grate 16. The filter fabric is typically made of a non-woven polypropylene fabric. This fabric holds back solids while allowing storm water to pass freely through the filter. The filter comprises a centrally located overflow opening 18 this opening allows storm water to flow over the over flow wall 24, directly through the grate, and into the catch basin chamber during high water levels. The overflow wall supports and maintains the opening at a higher elevation than the surrounding filter fabric. During normal water flow, the barrier wall prevents water from flowing into the over flow opening. The wall typically comprises foam rubber. This allows the wall to essentially flatten under traffic weight and then return to its original height when the weight departs. The filter fabric has an outer filter edge 28. When in use, the filter is attached to the grate by forming a bottom opening smaller than the grate. When the cord is tied, it holds the filter in place around the grate. The pull cord is pulled through grommets 26. When inserting the filter into the catch basin for use, the grate is removed from the catch basin, the apparatus is coupled to the grate, and the grate is reinserted into the catch basin. To remove the filter, the grate is lifted up and out of the catch basin and the pull cord is released allowing the grate to separate from the filter.

While we have illustrated and described a preferred embodiment of our invention, we wish to not be thereby limited to this preferred embodiment, but wish to include such changes and variations as fall within the scope of the following claims.

What we claim as our invention is:

1. In a catch basin used for collecting fluids, said catch basin having a cover grate, said grate having a top surface and a bottom surface, a catch basin filter comprising:

a) a filtering medium substantially covering said top surface of said grate;

b) an overflow bypass opening located within said filtering medium, wherein said fluids have ingress into said catch basin through said overflow bypass opening; and c) a barrier attached to said filter and surrounding said overflow bypass opening, said barrier further comprising a first height, said first height shortening to a second height upon the application of a force acting on said barrier, said second height lengthening to substantially said first height when said force is removed.

2. The filter of claim 1, wherein said barrier comprises foam rubber.

3. In a drain basin with a grate and having a filter positioned on top of said grate, the improvement wherein said filter comprises an overflow bypass through said filter; wherein said bypass comprises a centrally located wall barrier that rises to a limited height such that during high water flow the bypass allows water to overflow the barrier into a bypass opening and;

wherein said barrier flatten under weight and returns to its original height when relieved of said weight.

4. The improvement of claim 3, wherein said barrier comprises form rubber.

5. In a drain basin with a grate and having a filter positioned on top of said grate, the improvement wherein said filter comprises an overflow bypass through said filter, and a bottom opening smaller than said grate for encircling and coupling said filter to said grate.

* * * * *